US006887836B2

(12) United States Patent
Majeti et al.

(10) Patent No.: US 6,887,836 B2
(45) Date of Patent: May 3, 2005

(54) HOME CARE COMPOSITIONS COMPRISING A DICARBOXY FUNCTIONALIZED POLYORGANOSILOXANE

(75) Inventors: Satyanarayana Majeti, Middletown, OH (US); Elizabeth Ann Brown Reno, Fairfield, OH (US); Stephen Andras Kovacs, Loveland, OH (US); Philippe Olier, Lyons (FR)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/430,516

(22) Filed: May 6, 2003

(65) Prior Publication Data

US 2003/0212232 A1 Nov. 13, 2003

Related U.S. Application Data

(60) Provisional application No. 60/378,998, filed on May 9, 2002.

(51) Int. Cl.[7] ..... C11D 3/37

(52) U.S. Cl. ..... 510/109; 510/191; 510/194; 510/218; 510/220; 510/229; 510/235; 510/258; 510/238; 510/276; 510/466; 510/475; 524/837; 528/26; 528/31

(58) Field of Search ..... 510/191, 194, 510/218, 200, 229, 235, 238, 276, 466, 475; 524/837; 528/26, 31

(56) References Cited

U.S. PATENT DOCUMENTS

| | | | | |
|---|---|---|---|---|
| 4,405,469 A | | 9/1983 | Hafner et al. | |
| 4,658,049 A | | 4/1987 | Nakano et al. | |
| 4,859,359 A | * | 8/1989 | DeMatteo et al. | 510/400 |
| 4,876,152 A | | 10/1989 | Kang | |
| 5,063,052 A | * | 11/1991 | Grollier et al. | 424/70.121 |
| 5,087,443 A | | 2/1992 | Chizat et al. | |
| 5,516,869 A | | 5/1996 | Lucarelli et al. | |
| 5,702,490 A | | 12/1997 | Kneip et al. | |
| 6,007,801 A | | 12/1999 | Hossel et al. | |
| 2003/0212231 A1 | * | 11/2003 | Olier | 528/10 |

FOREIGN PATENT DOCUMENTS

| | | |
|---|---|---|
| EP | 196 169 | 4/1986 |

* cited by examiner

*Primary Examiner*—Randy Gulakowski
*Assistant Examiner*—Marc S. Zimmer
(74) *Attorney, Agent, or Firm*—Emelyn DeLeon Hiland

(57) ABSTRACT

Disclosed are home care compositions comprising a dicarboxy functionalized polyorganosiloxane and methods for treating and modifying surfaces and for enhancing delivery of active agents to surfaces treated with the compositions. Said home care compositions can be used particularly for cleaning, rinsing, care or treatment of industrial, domestic or communal hard surfaces, as well as textile article surfaces; they are targeted at conferring on the surfaces treated therewith benefits such as water repellency, soil release, stain resistance, anti-fogging, surface repair, anti-wrinkling, shine, lubrication and/or at improving the residuality, impact and or efficacy of active materials comprised in said compositions. The dicarboxy functionalized polyorganosiloxane can be present in the home care compositions at a concentration of from about 0.005% to 10% by weight, preferably from about 0.05% to 5% by weight.

14 Claims, No Drawings

HOME CARE COMPOSITIONS COMPRISING A DICARBOXY FUNCTIONALIZED POLYORGANOSILOXANE

CROSS REFERENCE TO RELATED APPLICATION

This application claims the benefit of U.S. Provisional Application No. 60/378,998, filed May 9, 2002.

FIELD OF THE INVENTION

The invention relates to home care formulations comprising a dicarboxy functionalized polyorganosiloxane; they can be used for the treatment of hard surfaces, as well as textile article surfaces.

BACKGROUND OF THE INVENTION

Organofunctional silicones are well-known in the art. The siloxane units may be functionalized with substituents such as carboxyalkyl (EP-A-196 169; U.S. Pat. No. 5,702,490), carboxyalkylaminoalkyl (U.S. Pat. No. 5,516,869), carboxyetheralkyl (U.S. Pat. No. 4,658,049), with radicals derived from alkenyl succinic anhydride (U.S. Pat. No. 4,876,152) optionally amidated (U.S. Pat. No. 6,007,801) and can be used for the treatment of surfaces in various type of industries, such as metal, leather, personal care, plastics, masonry It has now been found that dicarboxy functionalized polyorganosiloxanes can be used in home care formulations, particularly in cleaning, rinsing or care compositions for the treatment of industrial, domestic or communal hard surfaces, as well as textile article surfaces, targeted at conferring on the above surfaces benefits such as water repellency, soil release, stain resistance, anti-fogging, surface repair, anti-wrinkling, shine, lubrication and/or at improving the residuality, impact and or efficacy of active materials comprised in said compositions on the surfaces treated therewith.

DETAILED DESCRIPTION OF THE INVENTION

While the specification concludes with claims, which particularly point out and distinctly claim the invention, it is believed the present invention will be better understood from the following description.

All percentages and ratios used herein are by weight of the total composition unless otherwise specified. All measurements are made at 25° C., unless otherwise specified.

Herein, "comprising" means that other steps and other ingredients which do not affect the end result can be added. This term encompasses the terms "consisting of" and "consisting essentially of".

The home care formulation according to the invention comprises at least one dicarboxy functionalized polyorganosiloxane having the formula (I)

$$X(R^4R^5\ Si\ O)p(R^6\ A\ Si\ O)q\ Y \qquad (I)$$

wherein the X end group represents a triorganosiloxyl end group of formula $R^1R^2R^3SiO$—, or a Z end group wherein Z represents —OH;

the Y end group represents a triorganosilyl end group of formula —$SiR^3R^2R^1$ or a W end group wherein W represents —H;

$R^1$ to $R^6$, which may be identical or different, each represents a linear or branched C1–C8 alkyl or phenyl radical, preferably methyl;

A represents a dicarboxy acid radical of formula

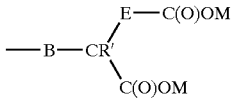

wherein

B represents an alkylene residue having from 2 to 30 carbon atoms, preferably from 3 to 8 carbon atoms, optionally substituted by one or more alkyl radicals having from 1 to 30 carbon atoms, R' represents a hydrogen atom or an alkyl radical having from 1 to 30 carbon atoms, and E is nil or is an alkylene residue having from 1 to 5 carbon atoms, preferably from 1 to 3 carbon atoms, optionally substituted by one or more alkyl radicals having from 1 to 30 carbon atoms; and M is H or a cation or an alkyl radical having from 1 to 4 carbon atoms optionally substituted with hydroxy or alkoxy groups;

p is an average value ranging from 0 to 1000, preferably from 0 to 500, more preferably from 5 to 200; and q is an average value ranging from 1 to 100, preferably from 1 to 50.

The ratio of the number of Z and W end groups to the total number of end groups X and Y ranges from 0/100 to 75/100, preferably from 0/100 to 30/100. The products where Z is —OH and/or Y is —H, are by-products.

The salts of the dicarboxy radical can be alkali metal (sodium, potassium, lithium) salts, alkaline earth metal (calcium, barium) salts, non substituted or substituted ammonium (methyl-, dimethyl-, trimethyl-, or tetramethylammonium, dimethylpiperidinium) salts or can derive from an alkanolamine (monoethanolamine, diethanolamine, triethanolamine).

In a preferred embodiment, the p/q ratio is from 1/3 to 99/1 (corresponding to 1–75% of pendant diacid groups relative to the siloxyl units), preferably from 1/1 to 10/1.

In addition to the mono- or diester derivatives of the dicarboxy radical, (M=alkyl), the present invention includes the amide and diamide derivatives.

The present dicarboxy functionalized siloxane polymers are generally prepared by a hydrosilylation reaction of a polyalkylhydrogensiloxane and an alpha-olefinic anhydride, the precursor of the dicarboxy A groups, with the aid of an effective amount of a hydrosilylation metal catalyst (platinum), as described for example, in U.S. Pat. Nos. 3,159,601; 3,159,662; and 3,814,730, followed by hydrolysis of the anhydride groups.

The hydrosilylation reaction can be carried out at a temperature from 20 to 200° C., preferably from 60 to 120° C., preferably with the aid of a platinum KARSTEDT catalyst (from 1 to 300 ppm, preferably from 5 to 50 ppm by weight of Pt). The relative quantities of polyalkylhydrogensiloxane and alpha alkenyl anhydride corresponds to a stoichiometric excess of alpha alkenyl anhydride (at most 5 moles of alpha alkenyl anhydride per mole of polyalkylhydrogensiloxane, preferably at most 2 moles of alpha alkenyl anhydride per mole of polyalkylhydrogensiloxane.

The hydrolysis reaction can be carried out with water at a temperature ranging from room temperature to 150° C., preferably from 40 to 120° C., with or without catalysts. Suitable catalysts for the reaction can be Lewis acids such as $TiCl_4$, $ZnCl_2$, $MgCl_2$, or Bronstedt acids or bases such as $CH_3COOH$, $H_2SO_4$, HCl, KOH, $NaHCO_3$, in an amount ranging from 0.05 to 5%.

Preferred polymers comprise one or a combination of the following dicarboxy acid pendant groups:

$$—(CH_2)_n—CH(COOM)_2$$

$$—(CH_2)_n—CH(COOM)—CH_2COOM$$

where n is from 2 to 30.

In a preferred embodiment, the diacid pendant group A in the functionalized polyorganosiloxane is $—(CH_2)_3—CH(COOM)—CH_2COOM$, the polymer prepared by a hydrosilylation reaction of a polyalkylhydrogensiloxane and allyl succinic anhydride followed by hydrolysis of the anhydride groups. Preferably, the polyalkylhydrogensiloxane is polydimethylhydrogensiloxane and the polymer is terminated with trimethylsilyl groups.

Said home care formulations can be used particularly for cleaning, rinsing, care or treatment of industrial, domestic or communal hard surfaces, as well as textile article surfaces; they are targeted at conferring on the latter benefits such as water repellency, soil release, stain resistance, anti-fogging, surface repair, anti-wrinkling, shine, lubrication and/or at improving the residuality, impact and or efficacy of active materials comprised in said compositions on the surfaces treated therewith.

The term "hard surfaces" more particularly means surfaces such as glass, windowpanes, ceramic, tiling, walls, floors, dishwares, stainless steel, hard organic polymer, wood; most particularly it means inorganic surfaces.

The dicarboxy functionalized polyorganosiloxane of formula (I) can be present in said formulations at a concentration of from about 0.005% to 10% by weight, preferably from about 0.05% to 5% by weight.

The home care formulation according to the invention can be applied to the surface to be treated in an amount such that it allows, after rinsing if necessary, and after drying, a deposit of dicarboxy functionalized polyorganosiloxane of from 0.0001 to 10 $g/m^2$, preferably from 0.001 to 1 $g/m^2$, of surface to be treated.

The home care formulation according to the invention preferably comprises at least one surfactant and/or at least one additive or active component.

Except when otherwise indicated, the proportions are shown in % by weight (in dry matter) based on the total weight of the home care formulation.

The surfactant is advantageously anionic and/or nonionic. It can also be cationic, amphoteric or zwitterionic.

Among the anionic surfactants which may be mentioned in particular are soaps such as salts of $C_8$–$C_{24}$ fatty acids, for example the salts of fatty acids derived from copra and from tallow; alkylbenzenesulphonates, in particular alkylbenzenesulphonates of linear $C_8$–$C_{,3}$ alkyl, in which the alkyl group comprises from 10 to 16 carbon atoms, alcohol-sulphates, ethoxylated alcohol-sulphates, hydroxyalkyl sulphonates; alkylsulphates and sulphonates, in particular of $C_{12}$–$C_{16}$, monoglyceride sulphates and condensates of fatty acid chlorides with hydroxyalkyl sulphonates.

Advantageous anionic surfactants are, in particular:

- alkyl ester sulphonates of formula $R—CH(SO_3M)—COOR'$, in which R represents a $C_8$–$C_{20}$, preferably $C_{10}$–$C_{16}$, alkyl radical, R' represents a $C_1$–$C_6$, preferably $C_1$–$C_3$, alkyl radical and M represents an alkali metal (sodium, potassium or lithium) cation, a substituted or unsubstituted ammonium (methyl-, dimethyl-, trimethyl- or tetramethylammonium, dimethylpiperidinium, etc.) cation or an alkanolamine derivative (monoethanolamine, diethanolamine, triethanolamine, etc.). Mention may be made most particularly of methyl ester sulphonates in which the radical R is $C_{14}$–$C_{16}$;
- alkylsulphates of formula $ROSO_3M$, in which R represents a $C_6$–$C_{24}$, preferably $C_{10}$–$C_{16}$, alkyl or hydroxyalkyl radical, M representing a hydrogen atom or a cation of the same definition as above, as well as the ethoxylenated (EO) and/or propoxylenated (PO) derivatives thereof, containing on average from 0.5 to 30, preferably from 0.5 to 10, EO and/or PO units;
- alkylamide sulphates of formula $RCONHR'OSO_3M$ in which R represents a $C_2$–$C_{22}$, preferably $C_6$–$C_{20}$, alkyl radical, R' represents a $C_2$–$C_3$ alkyl radical, M representing a hydrogen atom or a cation of the same definition as above, as well as the ethoxylenated (EO) and/or propoxylenated (PO) derivatives thereof, containing on average from 0.5 to 60 EO and/or PO units;
- salts of $C_8$–$C_{24}$, preferably $C_{14}$–$C_{20}$, saturated or unsaturated fatty acids, $C_9$–$C_{20}$ alkylbenzenesulphonates, primary or secondary $C_8$–$C_{22}$ alkylsulphonates, alkylglyceryl sulphonates, the sulphonated polycarboxylic acids described in GB-A-1,082,179, paraffin sulphonates, N-acyl N-alkyltaurates, alkylphosphates, isethionates, alkylsuccinamates, alkylsulphosuccinates, sulphosuccinate monoesters or diesters, N-acyl sarcosinates, alkylglycoside sulphates, polyethoxycarboxylates, the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine derivative (monoethanolamine, diethanolamine, triethanolamine, etc.);
- alkyl or alkylaryl phosphate esters such as Rhodafac RA600, Rhodafac PA15 or Rhodafac PA23 sold by the company Rhodia.

Among the nonionic surfactants which may be mentioned in particular are condensates of alkylene oxide, in particular of ethylene oxide, with alcohols, polyols, alkylphenols, fatty acid esters, fatty acid amides and fatty amines; oxide amines, sugar derivatives such as polyalkylglycosides or fatty acid esters of sugars, in particular sucrose monopalmitate; long-chain tertiary phosphine oxides; dialkyl sulphoxides; block copolymers of polyoxyethylene and of polyoxypropylene; polyalkoxylated sorbitan esters; fatty esters of sorbitan, poly(ethylene oxide) and fatty acid amides modified so as to give them a hydrophobic nature (for example fatty acid mono- and diethanolamides containing from 10 to 18 carbon atoms).

Mention may be made most particularly of

- polyoxyalkylenated (polyethoxyethylenated, polyoxypropylenated or polyoxybutylenated) alkylphenols in which the alkyl substituent is $C_6$–$C_{12}$ and containing from 5 to 25 oxyalkylene units; by way of example, mention may be made of Triton X-45, X-114, X-100 or X-102 sold by Rohm & Haas Co.;
- glucosamides, glucamides and glycerolamides;
- polyoxyalkylenated $C_8$–$C_{22}$ aliphatic alcohols containing from 1 to 25 oxyalkylene (oxyethylene, oxypropylene) units. By way of example, mention may be made of Tergitol 15-S-9 or Tergitol 24-L-6 NMW sold by Union Carbide Corp., Neodol 45-9, Neodol 23-65, Neodol 45-7 and Neodol 454 sold by Shell Chemical Co., and Rhodasurf ID060, Rhodasurf LA90 and Rhodasurf IT070 sold by the company Rhodia;

amine oxides such as dimethylamine $C_{10}$–$C_{18}$ alkyl oxides and ($C_8$–$C_{22}$) alkoxyethyldihydroxyethylamine oxides;

the alkylpolyglycosides described in U.S. Pat. No. 4,565,647;

$C_8$–$C_{20}$ fatty acid amides;

ethoxylated fatty acids;

ethoxylated amines.

Cationic surfactants are, in particular, alkylammonium salts of formula $R^1R^2R^3R^4N^+X^-$ in which $X^-$ represents a halide, $CH_3SO_4^-$ or $C_2H_5SO_4^-$ ion $R^1$ and $R^2$ are similar or different and represent a $C_1$–$C_{20}$ alkyl radical or an aryl or benzyl radical $R^3$ and $R^4$ are similar or different and represent a $C_1$–$C_{20}$ alkyl radical, an aryl or benzyl radical or an ethylene oxide and/or propylene oxide condensate $(CH_2CH_2O)_x$—$(CH_2CHCH_3O)_y$—H, in which x and y range from 0 to 30 and are never simultaneously zero, such as cetyltrimethylammonium bromide, Rhodaquat® TFR sold by the company Rhodia. Examples of zwitterionic surfactants comprise aliphatic quaternary ammonium derivatives, in particular 3-(N,N-dimethyl-N-hexadecylammonio)propane-1-sulphonate and 3-(N,N-dimethyl-N-hexadecylammonio)-2-hydroxypropane-1-sulphonate. Examples of amphoteric surfactants comprise betaines, sulphobetaines and carboxylates and sulphonates of fatty acids and of imidazole, such as alkyldimethylbetaines, alkylamidopropyldimethylbetaines, alkyldimethylsulphobetaines or alkylamidopropyldimethylsulphobetaines, such as Mirataine CBS sold by the company Rhodia, and the products of condensation of fatty acids and of protein hydrolysates;

alkylamphoacetates or alkylamphodiacetates in which the alkyl group contains from 6 to 20 carbon atoms;

amphoteric alkylpolyamine derivatives such as Amphionic XL® sold by Rhodia and Ampholac 7T/X® and Ampholac 7C/X® sold by Berol Nobel.

Additional examples of suitable surfactants are compounds generally used as surfactants denoted in the renowned texts *Surface Active Agents,* volume I by Schwartz and Perry, and *Surface Active Agents and Detergents,* volume II by Schwartz, Perry and Berch. The surfactants can be present in a proportion of from about 0.005% to about 60% by weight, in particular from about 0.5% to about 40% by weight, more preferably from about 0.1% to about 25% by weight, depending on the nature of the surfactant(s) and the destination of the home care formulation.

Mention may be made, among the other common additives and/or active agents which are part of the formulation of cleaning, rinsing or care compositions, of:

organic builders (detergency adjuvants which improve the surface properties of surfactants) of the type:

organic phosphonates, such as those of the Briquest® range from Rhodia (in an amount of from 0 to about 2%);

polycarboxylic acids or their water-soluble salts and water-soluble salts of carboxylic polymers or copolymers, such as polycarboxylate or hydroxypolycarboxylate ethers polyacetic acids or their salts (nitriloacetic acid, N,N-dicarboxymethyl-2-aminopentanedioic acid, ethylenediaminetetraacetic acid, diethylenetriaminepentaacetic acid, ethylenediaminetetraacetates, nitrilotriacetates, such as Nervanaid NTA $Na_3$, sold by the company Rhodia, or N-(2-hydroxyethyl)nitrilodiacetates) (in an amount of from 0 to about 10%);

($C_5$–$C_{20}$ alkyl)succinic acid salts polycarboxylic acetal esters polyaspartic or polyglutamic acid salts citric acid, gluconic acid or tartaric acid or their salts (in an amount of from 0 to about 10%);

inorganic builders (detergency adjuvants which improve the surface properties of surfactants) of the type:

alkali metal, ammonium or alkanolamine polyphosphates, such as Rhodiaphos HPA3.5, sold by the company Rhodia (in an amount of from 0 to about 70%)

alkali metal pyrophosphates;

zeolites;

silicates (in an amount which can range up to approximately 50%);

alkali metal or alkaline earth metal borates, carbonates, bicarbonates or sesquicarbonates (in an amount which can range up to approximately 50%)

cogranules of alkali metal (sodium or potassium) silicate hydrates and of alkali metal (sodium or potassium) carbonates disclosed in EP-A-488,868, such as Nabion 15, sold by the company Rhodia (in an amount which can range up to approximately 50%) (it being possible for the total amount of organic and/or inorganic builders to represent up to about 90% of the total weight of said cleaning, rinsing or care composition);

bleaching active agents of the perborates or percarbonates type, which may or may not be combined with acetylated bleaching activators, such as N,N,N',N'-tetraacetylethylenediamine (TAED), or chlorinated products of the chloroisocyanurates type, or chlorinated products of the alkali metal hypochlorites type (in an amount of from 0 to about 30%);

auxiliary cleaning agents of the copolymers of acrylic acid and of maleic anhydride or acrylic acid homopolymers type (in an amount of from 0 to about 10%);

hydrophobic or hydrophilic biocidal active agents

A biocidal agent is considered as being "hydrophobic" when its solubility in water at 25° C. is less than about 1% by weight, preferably less than about 0.1% by weight.

As examples of hydrophobic biocidal agents, mention may be made of para-chloro-meta-xylenol or dichloro-meta-xylenol 4-chloro-m-cresol resorcinol monoacetate mono- or poly-alkyl or -aryl phenols, cresols or resorcinols, such as o-phenylphenol, p-tert-butylphenol or 6-n-amyl-m-cresol alkyl and/or aryl-chloro- or -bromophenols, such as o-benzyl-p-chlorophenol halogenated diphenyl ethers such as 2',4,4'-trichloro-2-hydroxy-diphenyl ether (triclosan) and 2,2'-dihydroxy-5,5'-dibromo-diphenyl ether chlorophenesin (p-chloro-phenylglyceric ether).

As examples of hydrophilic biocidal agents, mention may be made of -cationic biocides such as quaternary monoammonium salts such as cocoalkylbenzyldimethylammonium, ($C_{12}$–$C_{14}$) alkylbenzyldimethylammonium, cocoalkyldichlorobenzyldimethylammonium, tetradecylbenzyldimethylammonium, didecyldimethylammonium or dioctyldimethylammonium chlorides, myristyltrimethylammonium or cetyltrimethylammonium bromides monoquaternary heterocyclic amine salts such as laurylpyridinium, cetylpyridinium or ($C_{12}$–$C_{14}$)alkylbenzylimidazolium chlorides triphenylphosphonium fatty alkyl salts such as myristyltriphenylphosphonium bromide polymeric biocides, such as those derived from the reaction of epichlorohydrin and of dimethylamine or of diethylamine of epichlorohydrin and of imidazole of 1,3-dichloro-2-propanol and of dimethylamine of 1,3-dichloro-2-propanol and of 1,3-bis(dimethylamino)-2-propanol of ethylene dichloride and of 1,3-bis(dimethylamino)-2-propanol of bis(2-chloroethyl) ether and of N,N'-bis(dimethylaminopropyl)-urea or thiourea biguanidine polymeric hydrochlorides, such as Vantocil IB amphoteric biocides such as derivatives of N-(N'-$C_8$-$C_{18}$alkyl-3-aminopropyl)glycine, of N-(N'-(N"-$C_8$-$C_{18}$alkyl-2-aminoethyl)-2-aminoethyl)glycine, of N,N-bis(N'-$C_8$-$C_{18}$alkyl-2-aminoethyl)glycine, such as (dodecyl)(aminopropyl)glycine and (dodecyl)(diethylenediamine)glycine amines such as N-(3-aminopropyl)-N-dodecyl-1,3-propanediamine halogenated biocides, for instance iodophores and hypochlorite salts, such as sodium dichloroisocyanurate phenolic biocides such as:

phenol, resorcinol and cresols.

synthetic cationic polymers, such as Mirapol A550® or Mirapol A15®, sold by Rhodia, or Merquat 550®, sold by Calgon;

polymers used to control the viscosity of the mixture and/or the stability of the foams formed during use, such as cellulose derivatives or guar derivatives (carboxymethylcellulose, hydroxyethylcellulose, hydroxypropylguar, carboxymethylguar, carboxymethylhydroxypropylguar, and the like);

hydrotropic agents, such as short-chain $C_2$–$C_8$ alcohols, in particular ethanol, diols and glycols, such as diethylene glycol, dipropylene glycol, and the like;

hydrating or moisturizing agents for the skin, such as glycerol or urea, or agents for protecting the skin, such as proteins or protein hydrolysates, or cationic polymers, such as cationic guar derivatives (Jaguar C13S®, Jaguar C162® or Hicare 1000®, sold by the company Rhodia.

perfumes or fragrances, such as the following odoriferous compounds or their mixture:

hexylcinnamaldehyde, 2-methyl-3-(para-tert-butylphenyl)propionaldehyde 7-acetyl-1,2,3,4,5,6,7,8-octahydro-1,1,6,7-tetramethylnaphthalene benzyl salicylate; 7-acetyl-1,1,3,4,4,6-hexamethyltetralin para-tert-butylcyclohexyl acetate methyl dihydrojasmonate; beta-naphthyl methyl ether methyl beta-naphthyl ketone; 2-methyl-2-(paraisopropylphenyl)propionaldehyde 1,3,4,6,7,8-hexahydro-4,6,6,7,8,8-hexamethylcyclopenta-gamma-2-benzopyran dodecahydro-3a,6,6,9a-tetramethylnaphtho[2,1-b]bifuran; anisaldehyde coumarin; cedrol; vanillin; cyclopentadecanolide tricyclodecenyl acetate; tricyclodecenyl propionate; phenylethyl alcohol terpineol; linalool; linalyl acetate; geraniol; nerol 2-(1,1-dimethylethyl)cyclohexanol acetate; benzyl acetate; terpenes (orange)

eugenol; diethyl phthalate essential oils, resins or resinoids (oil of orange, lemon, patchouli, Peru balm, Oilbanum resinoid, styrax, coriander, lavandin, lavender, etc.).

Other examples of odoriferous compounds are described in H 1468 (United States Statutory Invention Registration).

a foam modifier, which can be used in compositions which have a tendency to produce an excess of lather during their use. An example of these materials are soaps. Soaps are fatty acid salts and comprise alkali metal soaps, in particular the sodium, potassium, ammonium and alkanolammonium salts of higher fatty acids containing from about 8 to 24 carbon atoms, and preferably from about 10 to about 20 carbon atoms. Particularly useful salts are the mono-, di- and triethanolamine salts, the sodium or potassium salts, or the mixed salts, of fatty acids derived from coconut oil and from ground walnut oil. The amount of soap can be at least about 0.005% by weight, preferably from about 0.5% to about 2% by weight. Additional examples of foam modifiers are organic solvents, hydrophobic silica, silicone oil and hydrocarbons.

fillers of the sodium sulfate or sodium chloride type, in an amount of from 0 to about 50%;

various other additives, such as agents which influence the pH of the detergent composition, in particular basifying additives (phosphates of alkali metals, carbonates, perborates or hydroxides or acidifying additives (carboxylic or polycarboxylic acids, alkali metal bicarbonates and sesquicarbonates, phosphoric and polyphosphoric acids, sulfonic acids, and the like); or enzymes, dyes or inhibitors of metal corrosion.

The composition of the invention is particularly suitable for cleaning ceramic surfaces (floor tiles, baths, sinks, etc.).

The cleaning formulation advantageously comprises from about 0.02% to about 5% by weight of dicarboxy functionalized polyorganosiloxane of formula (I) relative to the total weight of said formulation, as well as at least one surfactant, preferably a nonionic surfactant. The amount of nonionic surfactants is generally from 0 to about 30% by, weight, preferably from 0 to about 20% by weight. An anionic surfactant can optionally be present in an amount of from 0 to about 30% by weight, advantageously from 0 to about 20% by weight. The total amount of surfactants used in this type of composition is generally between about 1.5% and about 50% by weight, preferably between about 5% and about 30% by weight and more particularly between about 10% and about 20% by weight.

The formulation can also contain organic or inorganic detergent adjuvants ("builders") as mentioned above; in general, the detergent adjuvant is used in an amount of between about 0.1 and about 25% by weight.

In addition to the ingredients mentioned above, the formulation can also contain other optional ingredients such as pH modifiers, foam modifiers (soaps), dyes, optical brighteners, soiling-suspension agents, detergent enzymes, compatible bleaching agents, agents for controlling gel formation, freezing-thawing stabilizers, bactericides, preserving agents, solvents, fungicides, insect repellents, hydrotropic agents, fragrances, opacifiers or pearlescent agents.

The pH of the composition is advantageously between about 3 and about 11.

The composition of the invention can also be used for cleaning toilet bowls. The cleaning formulation advantageously comprises from about 0.05% to about 5% by weight of dicarboxy functionalized polyorganosiloxane of formula (I) relative to the total weight of said formulation. The composition for cleaning toilet bowls also comprises from about 0.5% to about 10% by weight of a surfactant so as to contribute towards removing soiling or so as to give foaming or wetting properties, or alternatively in order to increase the cleaning efficacy of the composition. The surfactant is preferably an anionic or nonionic surfactant. Cationic surfactants can also be added in order to provide germicidal properties.

The composition for cleaning toilet bowls can also comprise an acidic cleaning agent which can consist of an inorganic acid such as phosphoric acid, sulphamic acid, hydrochloric acid, hydrofluoric acid, sulphuric acid, nitric acid or chromic acid and mixtures thereof or an organic acid, in particular acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid or tartaric acid and mixtures thereof, acid salts such as sodium bisulphate, and mixtures thereof. The amount of acid ingredients is preferably between about 0.1% and about 40% by weight, and preferably between about 0.5% and about 15% by weight.

The composition for cleaning toilet bowls can also comprise a thickener such as a gum, in particular a xanthan gum, added at a concentration of from about 0.1% to about 3%, as well as one or more of the following minor ingredients (a preserving agent intended to prevent the growth of microorganisms in the product, a dye, a fragrance and/or an abrasive agent).

The pH of the composition is from about 0.5 to about 12.

The composition according to the invention is also suitable for rinsing shower walls.

The rinsing formulation advantageously comprises from about 0.02% to about 5% by weight of dicarboxy functionalized polyorganosiloxane of formula (I) relative to the total weight of said formulation. The other main active components of the aqueous compositions for rinsing showers are at least one surfactant (polyethoxylated fatty esters, alkylpolyglucosides) present in an amount ranging from about 0.5 to about 5% by weight and optionally a metal-chelating agent present in an amount ranging from about 0.01 to about 5% by weight. The preferred metal-chelating agents are ethylenediaminetetraacetic acid (EDTA) and analogues thereof.

The aqueous compositions for rinsing showers advantageously contain water with, optionally, at least one lower alcohol in major proportion and additives in minor proportion (between about 0.1% and about 5% by weight, more advantageously between about 0.5% and about 3% by weight and even more preferably between about 1% and about 2% by weight).

The pH of the composition is advantageously between about 7 and about 11.

The composition according to the invention can also be used for cleaning glass-ceramic plates.

The formulation for cleaning glass-ceramic plates advantageously comprises from about 0.1% to about 5% by weight of dicarboxy functionalized polyorganosiloxane of formula (I) relative to the total weight of said formulation. Advantageously, the formulations for cleaning glass-ceramic plates comprise a thickener such as a xanthan gum (from about 0.1 to about 1%), an abrasive agent such as calcium carbonate or silica (from about 10% to about 40%), a glycol such as butyldiglycol (from 0 to about 7%), a nonionic surfactant (from about 1% to about 10%) and optionally basifying agents or sequestering agents.

The pH of the composition is advantageously between about 7 and about 12.

The composition of the invention is also advantageous for cleaning dishes by hand or in an automatic device.

The formulation for hand cleaning dishes advantageously comprises from about 0.05% to about 5% by weight of dicarboxy functionalized polyorganosiloxane of formula (I) relative to the total weight of said formulation.

In the case of cleaning dishes in an automatic device, said dicarboxy functionalized silicone can be present either in the detergent formula used in the washing cycle or in the rinsing liquid.

The cleaning formulation for autodishwashers also comprise:

- from about 0.2% to about 10% by weight, advantageously from about 0.5% to about 5% by weight, relative to the total weight of said formulation, of a surfactant, preferably a nonionic surfactant, and optionally
- up to about 90% by weight, relative to the total weight of said formulation, of detergent adjuvants ("builders");
- up to about 30% by weight, relative to the total weight of said formulation, of a bleaching agent such as perborate or percarbonate, which may or may not be combined with a bleaching activator;
- up to about 10% by weight, relative to the total weight of said formulation, of auxiliary cleaning agents (such as copolymers of acrylic acid and maleic anhydride or acrylic acid homopolymers);
- up to 5 about 0% by weight, relative to the total weight of said formulation, of fillers such as sodium sulphate or sodium chloride;
- various other additives, for instance fragrances, dyes, metal-corrosion inhibitors, agents which influence the pH of the formulation, or enzymes in the case of solid compositions.

The pH of the formulation is advantageously between about 8 and about 12.

Formulations for rinsing dishes in an automatic dishwasher advantageously also comprise from about 0.2 to about 20%, preferably from about 0.5 to about 15%, of a surfactant, preferably a nonionic surfactant or a mixture of nonionic and anionic surfactant.They also comprise from 0 to about 10%, preferably from about 0.5 to about 5% of a calcium-sequestering organic acid, preferably citric acid. They can also comprise an auxiliary agent of copolymer of acrylic acid and of maleic anhydride or acrylic acid homopolymers type, in an amount of from 0 to about 15%, preferably from 0.5 to about 10%.

The pH of the formulation is advantageously between about 4 and about 7.

The composition of the invention is also advantageous for washing up dishes by hand.

Preferred liquid detergent formulations of this type also comprise from about 3 to about 50, preferably from about 10 to about 40, parts by weight of at least one surfactant, preferably an anionic surfactant, chosen in particular from sulfates of saturated $C_5$–$C_{24}$, preferably $C_{10}$–$C_{16}$, aliphatic alcohols, optionally condensed with approximately from about 0.5 to about 30, preferably from about 0.5 to about 5, particularly from about 0.5 to about 3, mol of ethylene oxide, in acid form or in the form of a salt, nonionic surfactants, such as amine oxides, alkylglucamides, oxyalkylenated fatty alcohol derivatives, alkylamides or alkanolamides, amphoteric surfactants or zwitterionic surfactants, bactericides or disinfectants, such as triclosan, synthetic cationic polymers, polymers for controlling the viscosity of the mixture and/or the stability of the foams formed during use, hydrotropic agents, hydrating or moisturizing agents or agents for protecting the skin, dyes, fragrances, preservatives, and the like.

The pH of the formulation is advantageously between about 6 and about 8.

The formulation of the invention can also be used for the treatment of glass surfaces, in particular window panes.

The formulation for cleaning window panes comprises:

from about 0.001% to about 10% by weight, preferably about 0.005 to about 3% by weight, of at least one dicarboxy functionalized polyorganosiloxane of formula (I);

from about 0.005% to about 20% by weight, preferably from about 0.5% to about 10% by weight, of at least one nonionic surfactant (for example an amine oxide) and/or anionic surfactant; and the remainder being formed of water and/or various additives which are common in the technical field.

The formulations for cleaning window panes can also contain:

from 0 to about 10%, advantageously from about 0.5% to about 5%, of amphoteric surfactant, from 0 to about 30%, advantageously from about 0.5% to about 15%, of solvent such as alcohols, and the remainder consisting of water and common additives (in particular fragrances).

The pH of the composition is advantageously between about 6 and about 11.

The composition of the invention can also be used for the external cleaning of motor vehicles, more particularly, the bodywork thereof. In this case also, the dicarboxy functionalized silicone according to the invention can be present either in a detergent formula used for the washing operation or in a rinsing product.

The formulation for external cleaning of of motor vehicles comprises from about 0.05% to about 5% by weight of at least one dicarboxy functionalized polyorganosiloxane of formula (I). The cleaning composition for motor vehicles advantageously comprises nonionic surfactants (in an amount of from 0 to about 30%, preferably from of about 0.5 to about 15%), amphoteric and/or zwitterionic surfactants (in an amount of from 0 to about 30%, preferably from of about 0.5 to about 15%), cationic surfactants (in an amount of from 0 to about 30%, preferably from about 0.5 to about 15%), anionic surfactants (in an amount of from 0 to about 30%, preferably from about 0.5 to about 15%), organic or inorganic detergency adjuvants (builders), hydrotropic agents, fillers, pH modifiers, and the like. The minimum amount of surfactant present in this type of composition is at least about 1% of the formulation.

The pH is avantageously between about 8 and about 12.

The composition of the invention can also be used for washing laundry, particularly polyamide, silk, cotton or wool fabrics.

The formulation for washing laundry comprises from about 0.01% to about 3% by weight of at least one dicarboxy functionalized polyorganosiloxane of formula (I). The other active component of the composition for washing laundry is at least one surfactant (in an amount of from about 5 to about 70%, preferably from about 5 to about 50%); said composition can also comprise at least an inorganic or organic detergent adjuvant (builder in an amount of from about 5 to about 50%), chelating agents, enzymes (proteases, amylases, lipases, peroxidases, up to about 5 mg by weight of active enzyme/g of composition), softeners such as clay (about 0.5- about 10%), fragrance, foam suppressants (up to about 5%), soil release polymers such as cellulose derivatives, ethyleneglycol terephthalate/polyethylene glycol copolymers, ethyleneglycol terephthalate/polyethylene glycol/polyisophthalate copolymers (about 0.01- about 10%), anti-redeposition agents such as carboxymethylcellulose (about 0.01- about 10%), anti-color transfert polymers such as polyvinylpyrrolidones (about 0.05- about 5%).

Another subject-matter of the invention is an aqueous biocidal home care formulation which contains from about about 0.01 to about 20%, preferably from about 0.03 to about 5%, of at least one biocidal agent optionally from about 0.1 to about 50%, preferably from about 0.5 to about 30%, of at least one surfactant, and from about 0.005 to about 10%, preferably from about 0.05 to about 10%, more particularly from about 0.05 to about 5%, of its weight of at least one dicarboxy functionalized polyorganosiloxane of formula (I).

If desired, a solubilizing agent can be present in said composition in order to facilitate the solubilization of said biocide. As examples of solubilizing agents, mention may be made of alcohols such as ethanol, isopropanol, propylene glycol or other solvents. Said formulation can be a detergent composition, in particular for washing up dishes by hand, for cleaning and disinfecting hard industrial, domestic or community surfaces.

The aqueous biocidal formulation may also comprise additives such as chelating agents [such as aminocarboxylates (ethylenediaminetetraacetates, nitrilotriacetates, N,N-bis(carboxymethyl)glutamates, citrates)], alcohols (ethanol, isopropanol, glycols), detergent adjuvants (phosphates, silicates), surfactants, dyes, fragrances or the like.

Compositions for washing up dishes by hand can also contain surfactants, viscosity-modifying agents, hydrotropic agents, fragrances, dyes or the like.

The cleaning or disinfection operation consists in applying or placing said aqueous biocidal formulation, optionally diluted from about 1 to about 1000 times, preferably from about 1 to about 100 times, in contact with the surface to be treated.

The amount of aqueous biocidal formulation which can favourably be used is that corresponding to a deposition of from about 0.01 to about 10 g, preferably from about 0.1 to about 1 g, of biocide per $m^2$ of surface and to a deposition of from about 0.001 to about 2 g, preferably from about 0.01 to about 0.5 g, of dicarboxy functionalized silicone per m2 of surface.

Among the microorganisms whose proliferation can be controlled using the biocidal formulation of the invention, mention may be made of Gram-negative bacteria such as: *Pseudomonas aeruginosa; Escherichia coli; Proteus mirabilis*

Gram-positive bacteria such as: *Staphylococcus aureus; Streptococcus faecium* other dangerous bacteria in food, such as: *Salmonella typhimurium; Listeria monocytogenes; Campylobacter jejuni; Yersinia enterocolitica* yeasts such as: *Saccharomyces cerevisiae; Candida albicans* fungi such as: *Aspergillus niger; Fusarium solani; Pencillium chrysogenum* algae such as: *Chlorella saccharophilia; Chlorella emersonii; Chlorella vulgaris; Chlamydomonas eugametos*

The biocidal formulation of the invention is most particularly effective on the Gram-negative microorganism *Pseudomonas aeruginosa*, the Gram-positive microorganism *Staphylococcus aureus*, and the fungus *Aspergillus niger.*

Further, the present aqueous biocidal compositions can be incorporated into an insoluble substrate for application to a surface such as in the form of a treated wipe. Suitable water insoluble substrate materials and methods of manufacture are described in Riedel, "Nonwoven Bonding Methods and Materials," *Nonwoven World* (1987); *The Encyclopedia Americana*, vol. 11, pp. 147–153, vol. 21, pp. 376–383, and vol. 26, pp. 566–581 (1984); U.S. Pat. No. 3,485,786 to Evans, issued Dec. 23, 1969; U.S. Pat. No. 2,862,251, to Kalwarres; U.S. Pat. No. 3,025,585, Kalwarres; U.S. Pat. No. 4,891,227, to Thaman et al., issued Jan. 2, 1990; and U.S. Pat. No. 4,891,228 and U.S. Pat. No. 5,686,088 to Mitra et al., issued Nov. 11, 1997; U.S. Pat. No. 5,674,591; James et al; issued Oct. 7, 1997.

Nonwoven substrates made from synthetic materials useful in the present invention can also be obtained from a wide variety of commercial sources. Nonlimiting examples of suitable nonwoven layer materials useful herein include PGI Miratec Herringbone, a patterned hydroentangled material containing about 30% rayon and 70% polyester, and having a basis weight of about 56 grams per square yard (gsy), available from PGI/Chicopee, Dayton N.J.; PGI Miratec Starburst, a patterned hydroentangled material containing about 30% rayon and 70% polyester, and having a basis weight of about 56 grams per square yard (gsy), available from PGI/Chicopee, Dayton N.J.; Novonet$^R$ 149–616, a thermo-bonded grid patterned material containing about 100% polypropylene, and having a basis weight of about 50 gsy, available from Veratec, Inc., Walpole, Mass.;

Novonet$^R$ 149-801, a thermo-bonded grid patterned material containing about 69% rayon, about 25% polypropylene, and about 6% cotton, and having a basis weight of about 75 gsy, available from Veratec, Inc. Walpole, Mass.; Novonet$^R$ 149–191, a thermo-bonded grid patterned material containing about 69% rayon, about 25% polypropylene, and about 6% cotton, and having a basis weight of about 100 gsy, available from Veratec, Inc. Walpole, Mass.; HEF Nubtex$^R$ 149-801, a nubbed, apertured hydroentangled material, containing about 100% polyester, and having a basis weight of about 70 gsy, available from Veratec, Inc. Walpole, Mass.; Keybak$^R$ 951V, a dry formed apertured material, containing about 75% rayon, about 25% acrylic fibers, and having a basis weight of about 43 gsy, available from PGI/Chicopee, Dayton, N.J.; Keybak$^R$ 1368, an apertured material, containing about 75% rayon, about 25% polyester, and having a basis weight of about 39 gsy, available from PGI/Chicopee, Dayton, N.J.; Duralace$^R$ 1236, an apertured, hydroentangled material, containing about 100% rayon, and having a basis weight from about 40 gsy to about 115 gsy, available from PGI/Chicopee, Dayton, N.J.; Duralace$^R$ 5904, an apertured, hydroentangled material, containing about 100% polyester, and having a basis weight from about 40 gsy to about 115 gsy, available from PGI/Chicopee, Dayton, N.J.; Sontara 8877, an apertured hydroentangled material, containing about 50% Nylon and about 50% Pulp, and having a basis weight of about 68 gsm, available from Dupont Chemical Corp. Alternatively, the water insoluble substrate can be a polymeric mesh sponge as described in U.S. Pat. No. 5,650,384. The polymeric sponge comprises a plurality of plies of an extruded tubular netting mesh prepared from a strong flexible polymer, such as addition polymers of olefin monomers and polyamides of polycarboxylic acids. Although these polymeric sponges are designed to be used in conjunction with a liquid cleanser, these types of sponges can be used as the water insoluble substrate in the present invention.

EXAMPLES

The following examples further describe and demonstrate embodiments within the scope of the present invention. These examples are given solely for the purpose of illustration and are not to be construed as limitations of the present invention as many variations thereof are possible without departing from the spirit and scope. All percentages used herein are by weight of the composition unless otherwise indicated.

Example 1

Preparation of a Dicarboxy Functionalized Polydimethylsiloxane having Pendant —$(CH_2)_3$—CH(COOH)—$CH_2$COOH Groups 93.7 g (i-e 0.67 mol) of allyl succinic anhydride, 52 g of toluene and 1.01 g of a Kardtedt catalyst solution (0.1% of Pt in hexamethyldisiloxane) are added into a 500 ml reactor. The reaction mass is heated at 90° C.; 120 g (i.e., 0.45 mol of SiH) of a polydimethylhydrogenosiloxane having the formula $$Me_3SiO(SiMe_2O)_9(SiMeHO)_4SiMe_3$$

and containing 3.75 mol of SiH/kg, are added over 3 hours. The SiH amount (determined by gazometry) transformed at the end of the addition is of 96.1%; it is of 100% 2 hours after the end of the addition. The volatiles are eliminated by evaporation under vacuum (3 mbar) over 10 hours at 150° C. 15 g of demineralized water are then added in order to hydrolyze the succinic anhydride functions. The hydrolysis reaction is followed by infrared analysis (acid band at 1714 $cm^{-1}$, anhydride band at 1863 and 1782 $cm^{-1}$). When the hydrolysis reaction is complete (48 hours), 100 g of toluene are added in order to azeotropically eliminate water. 133.5 g (corresponding to a yield of 82%) of a viscous oil are recovered.

NMR analysis confirmed the following general structure of the product obtained:

$$Me_3SiO(SiMe_2O)_9(SiMeAO)_4SiMe_3$$

in which A represents —$(CH_2)_3$—CH(COOH)—$CH_2$COOH Said product can be heated up to 60° C. and then dispersed by homogenization in a surfactant, if it is applied in a home care composition having an acid pH. Said product is water dispersible if the pH is above 10.

Example 2

Preparation of a Dicarboxy Functionalized Polydimethylsiloxane having Pendant —$(CH_2)_3$—CH(COOH)—$CH_2$COOH Groups 49.8 g (i-e 0.36 mol) of allyl succinic anhydride, 44 g of toluene and 1.139 g of a Kardtedt catalyst solution (0.1% of Pt in hexamethyldisiloxane) are added into a 500 ml reactor.

The reaction mass is heated at 90° C.; 150.3 g (i.e., 0.266 mol of SiH) of a polydimethylhydrogenosiloxane having the formula $$Me_3SiO(SiMe_2O)_{100}(SiMeHO)_{15}SiMe_3$$

and containing 1.77 mol of SiH/kg, are added over 1 hour. The SiH amount (determined by gazometry) transformed at the end of the addition is of 86%; it is of 100% 16 hours after the end of the addition. The volatiles are eliminated by evaporation under vacuum (6 mbar) over 10 hours at 150° C. 101 g of toluene are added; the reaction mass is filtered. 6.7 g of demineralized water are then added in order to hydrolyze the succinic anhydride functions. The hydrolysis reaction is followed by infrared analysis (acid band at 1714 $cm^{-1}$, anhydride band at 1866 and 1788 $cm^{-1}$). When the hydrolysis reaction is complete (6 days), water is azeotropically eliminated. 146.3 g (corresponding to a yield of 80%) of a viscous oil are recovered.

NMR analysis confirmed the following general structure of the product obtained:

$$Me_3SiO(SiMe_2O)_{100}(SiMeAO)_{15}SiMe_3$$

in which A represents $—(CH_2)_3—CH(COOH)—CH_2COOH$

Example 3

Glass Cleaning Formulations

Glass cleaning formulations are recorded in the table below:

| Components | Formulation | | | |
|---|---|---|---|---|
| | F1 comp | F2 comp | F3 | F4 |
| Isopropyl alcohol | 7 | 15 | 7 | 15 |
| Ethoxylated (7 EO) fatty ($C_{12}$) alcohol | 0 | 3 | 0 | 3 |
| Sodium dodecylbenzenesulfonate | 0.5 | 0 | 0.5 | 0 |
| Ammonium hydroxide | 0.3 | 0.3 | 0.3 | 0.3 |
| Dipropylene glycol monomethyl ether | 0.25 | 0.5 | 0.25 | 0.5 |
| Product of example 1 | — | | 0.5 | 1 |
| Water | q.s. for 100 | q.s. for 100 | q.s. for 100 | q.s. for 100 |

Evaluation Method

Glass slides (GS) of Obertrager type are treated by spraying the F1–F4 above formulations thereon. Then, they are either rinsed (R) with pure water or not rinsed (NR). The following treated glass slides are thus prepared:

| | |
|---|---|
| GS F1comp./NR | (GS treated with comparative F1, not rinsed) |
| GS F2comp./NR | (GS treated with comparative F2, not rinsed) |
| GS F3/NR | (GS treated with F3, not rinsed) |
| GS F3/R | (GS treated with F3, rinsed) |
| GS F4/NR | (GS treated with F4, not rinsed) |
| GS F4/R | (GS treated with F4, rinsed) |

A measurement of contact angle between water and the surface of each slide is carried out on a Ramé-Hart assembly. Then, each treated glass slide is stained by coating with a model stain formulation made of:

| | |
|---|---|
| water (75%) and a blend of (25%) colza oil | (10%) |
| cellulose | (25%) |
| cholesterol | (25%) |
| olive oil | (10% |
| calcium diphosphate | (15%) |
| iron phosphate | (15%) |

After a drying period of 15 minutes, each slide is rinsed with pure water. The amount of residual stain at the surface is evaluated through image analysis. The results are given in terms of amount of residual stain after rinsing as compared to the whole treated surface. 100% means that none of the stain is removed; the higher the amount of residual stain, the lower the performance of the product.

| | GS F1comp/NR | GS F2comp/NR | GS F3/NR | GS F3/R | GS F4/NR | GS F4/R |
|---|---|---|---|---|---|---|
| Contact angle | 10° | 15° | 50° | 42° | 53° | 45° |
| Amount of residual stain after rinsing | 40% | 60% | 10% | 25% | 10% | 20% |

These results show that the product of Example 1 provides soil-release properties and prevents soil adhesion onto glass surfaces, eventhough hydrophilisation is not achieved. An anti-fogging benefit is also noted.

The above formulations F3 and F4 (or the same formulations with product of Example 2) can be used as an all purpose cleaner, particularly for cleaning windows or rinsing shower walls. They are used as is by spraying at the surfaces of the windows or the shower walls (3 to 5 g of formulation per $m^2$ of surface). The products of example 1 or 2 confer on the surface efficient anti-fogging and soil repellency benefits.

Example 4

Formulations C1–C4 recorded in the table below are tested with the same methodology as in example 3 on ceramic tiles (CT) (instead of glass slides). The results of stain removability on ceramic tiles are given in the table below

| | |
|---|---|
| CT C1comp./NR | (CT treated with comparative C1, not rinsed) |
| CT C2/R | (CT treated with C2, rinsed) |
| CT C3/R | (CT treated with C3, rinsed) |
| CT C4/R | (CT treated with C4, rinsed) |

| Components | Composition | | | |
|---|---|---|---|---|
| | C1comp | C2 | C3 | C4 |
| $C_{13}$-3PO-7EO (EO/PO linear fatty alcohol) | 12 | 12 | 12 | 12 |
| Sodium laurylbenzene sulphonate | 3 | 3 | 3 | 3 |
| Product of example 1 | 0 | 1 | 2 | 3.5 |
| Water | q.s. for to 100 | q.s. for to 100 | q.s. for to 100 | q.s. for to 100 |
| Amount of stain removed after rinsing | 45% | 70% | 80% | 95% |

The above compositions C2–C4 (or the same compositions with the product of Example 2) can be used as rinse aid in automatic dishwashing or as toilet bowls cleaner.

Example 5

Detergent formulations D1 and D2 recorded in the table below are tested on ceramic tiles with the classical soap scum test.

| Components | Formulation | |
|---|---|---|
| | D1 Comparative % by weight | D2 % by weight |
| Sodium ($C_{12}$)alkylsulfonate | 24 | 24 |
| Ethoxylated $C_{12}$ fatty alcohol—6 EO | 5 | 5 |
| Ethanol | 4 | 4 |
| Product of example 1 | — | 2 |
| Water | q.s. for to 100 | q.s. for to 100 |
| Result of the evaluation | 5 | 1–2 |

The stain composition is as follows:

| Components | Parts |
|---|---|
| Palmitic acid | 10 |
| Stearic acid | 5 |
| Parrafin wax | 10 |
| Coconut oil | 15 |
| Olive oil | 20 |
| Squalene | 5 |
| Cholesterol | 5 |
| Oleic acid | 10 |
| Linoleic acid | 5 |

Testing Procedure i). Thoroughly wash ceramic tiles with alcohol.

ii). Position test tile upright. Position sprayer containing hard water solution approximately 30.48 cm (12 inches) from tile target. With a downward sweeping motion, execute 2 complete sprays of hard water solution immediately followed by 2 complete sprays of soap scum soil from the same target distance. Repeat this procedure twice more for a total of 3 soiling cycles allowing 30 minutes between each cycle. When soiling is complete, allow soil to "set up" by drying overnight at room temperature.

iii). Shield half of the test tile (left side) using any suitable means (stainless steel panel, glass panel, or another ceramic tile ); to the exposed side, apply formulation D2 by spraying evenly to ensure complete coverage. Allow to penetrate soil for 30 seconds. Shield the other half (right side) and apply comparative formulation D1 to the exposed side; allow to penetrate soil for 30 seconds.

iv). Rinse and dry for evaluation v). Visually examine tiles for residual soap scum soil, streaking and spotting by comparing both sides of the tile.

Rate treated side on a numeric scale from 1 to 5. (A panel of 3 or more evaluators to ensure validity)

1=totally clean, no residue, streaking or spotting

5=heavily soiled

The results (in the table above) show that formulation D2 provides an efficient soil removal. This formulation can be used in bathroom cleaning application (shower wall rinsing) and kitchen cleaner formulations.

Examples 6–7

All Purpose Cleaner (for Surfaces such as Tiles, Ceramics, Sinks and Baths, Stainless Steel)

The formulation is prepared from the components given in the table below.

| Components | Formulations (by weight) | |
|---|---|---|
| | Example 6 | Example 7 |
| Ethoxylated (7 EO) $C_{12}$ fatty alcohol | 6 | 8 |
| Sodium alkyl ($C_{12}$) sulfonate | 3 | 2 |
| Sodium hydroxide | Such that pH = 10.4 | such that pH = 10.4 |
| Product of Example 1 or 2 | 0.1 | 0.5 |
| Water | qs 100 | qs 100 |

The formulations of Examples 6 and 7 are used as is or they can be diluted before use, to a rate of 10 g of formulation in 1 litre of water.

They confer on the surface efficient soil repellency, shine, surface repair and next step easy cleaning benefit.

Examples 8 to 11

Detergent Formulation for Automatic Dishwashers

A base detergent formulation is prepared from the compounds given in the table below:

| Formulation | Example 8 | Example 9 | Example 10 | Example 11 |
|---|---|---|---|---|
| Sodium tripolyphosphate | 0 | 0 | 60 | 35 |
| Sodium carbonate | 35 | 30 | 0 | 20 |
| Sodium disilicate | 20 | 15 | 23 | 10 |
| Sodium citrate | 20 | 15 | 0 | 0 |
| Sodium sulfate | 0 | 20 | 0 | 19 |
| Sodium polyacrylate CP5 from BASF | 6 | 5 | 0 | 0 |
| Plurafac LF 403 | 3.5 | 1 | 3.5 | 2 |
| Bleaching system (perborate1 $H_2O$ + TAED) | 12 | 10 | 10 | 10 |
| Other additives (including benzotriazole, enzymes, fragrance) | 3 | 3 | 3 | 3 |
| Product of Ex. 1 or 2 | 0.5 | 1 | 0.5 | 1 |

These formulations confer on the surface soil repellency, shine, surface repair and next step easy cleaning benefit.

Examples 12–13

Formulation for Hand Dishwashing

The formulation is prepared from the components given in the table below.

| Formulation | Example 12 | Example 13 |
|---|---|---|
| Sodium alkyl sulfonate ($C_{14}$) | 24 | 12 |
| Ethoxylated (1.5 EO) $C_{12}$ fatty alcohol | 5 | 3 |
| Ethoxylated (7EO) $C_{10}$ fatty alcohol | 4 | 4 |
| Product of example 1 or 2 | 2 | 2 |
| Water | Qs 100 | qs 100 |

Example 14

Toilet Bowl Cleaner (Gel)

The formulation is prepared from the components given in the table below.

| Formulation | % by weight |
|---|---|
| Perfume | 5 |
| Monopropyleneglycol | 12.3 |
| Amphoteric surfactant (Mirataine CBSE from Rhodia) | 6 |
| Ethoxylated (7EO) $C_{13}$ fatty alcohol | 6.6 |
| Xanthan gum | 1 |
| Product of example 1 or 2 | 0.5 |
| Water | qs 100 |

Product of Example 1 is also found efficient in substantiating a peroxide containing formulation next to the toilet bowl surface. A bleach effect is sustainable up to a few hours after application of the product.

Example 15

Car Wash Formulation

The formulation is prepared from the components given in the table below.

| Formulation | % by weight |
|---|---|
| Na Laurylbenzene sulphonate | 2 |
| Ethoxylated (5 EO) $C_{14}$ fatty alcohol | 2 |
| EDTA | 0.05 |
| Product of example 1 or 2 | 0.1 |
| Water | qs 100 |

Example 16

Formulation for Rinsing Shower Walls

The formulation is prepared from the components given in the table below.

| Formulation | % by weight |
|---|---|
| Ethoxylated (5 EO) $C_{12}$ fatty alcohol | 5 |
| EDTA | 0.1 |
| Triclosan (biocide) | 0.2 |
| Xanthan gum | 1 |
| Product of Example 1 or 2 | 0.5 |
| Water | qs 100 |

Example 17

Aqueous biocidal compositions for hand dishwashing are prepared by using:

25 parts by weight (expressed as solids) of lauryl ether sulfate 10 parts by weight (expressed as solids) of sodium paraffin sulfonate 5 parts by weight of sodium cocoamphoacetate 0.2 part by weight of triclosan 1 part by weight of the product of example 1 or 2, and water to obtain 100 parts of composition.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Home care formulation comprising a) at least one dicarboxy functionalized polyorganosiloxane having formula (I)

$$X(R^4R^5Si\ O)p(R^6\ A\ Si\ O)q\ Y \qquad (I)$$

wherein

X represents a triorganosiloxyl end group of formula $R^1R^2R^3SiO$—, or a Z end group wherein Z represents —OH;

Y represents a triorganosilyl end group of formula —$SiR^3R^2R^1$ or a W end group wherein W represents —H;

$R^1$ to $R^6$, which may be identical or different, each represents a linear or branched C1–C8 alkyl or phenyl radical;

A represents a dicarboxy acid radical of formula

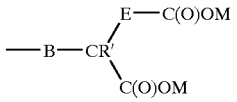

wherein

B represents an alkylene residue having from 2 to 30 carbon atoms, optionally substituted by one or more alkyl radicals having from 1 to 30 carbon atoms, R' represents a hydrogen atom or an alkyl radical having from 1 to 30 carbon atoms, and E is nil or is an alkylene residue having from 1 to 5 carbon atoms, optionally substituted by one or more alkyl radicals having from 1 to 30 carbon atoms; and M is H, an alkyl group having from 1 to 4 carbon atoms optionally substituted with hydroxy or alkoxy groups, or a cation selected from the group consisting of alkali metal, alkaline earth metal, and substituted or non substituted ammonium, piperidinium or alkanolamine;

p is an average value ranging from 0 to 1000;

q is an average value ranging from 1 to 100; and the ratio of the number of Z and W end groups to the total number of X and Y end groups is from 0/100 to 75/100 and b) at least one surfactant and at least one additive or active agent selected from detergent adjuvants or builders, auxiliary cleaning agents, acidic cleaning agents, metal chelating agents, calcium-sequestering agents, hydrotropic agents, bleaching agents, abrasives, biocidal or antimicrobial agents, corrosion inhibitors, enzymes, anti-redeposition agents, anti-color transfer agents, and soil-release agents, wherein the amounts of polyorganosiloxane, surfactant and additive or active agent are effective to clean, rinse, repair, care for, or treat industrial, domestic or communal hard surfaces or textile article surfaces.

2. Home care formulation according to claim 1, in which A represents a

—$(CH_2)_3$—CH(COOM)—$CH_2$COOM group.

3. Home care formulation according to claim 1, comprising from about 0.005% to about 10% by weight of said formulation of said dicarboxy functionalized polyorganosiloxane.

4. Home care formulation according to claim 1, for cleaning ceramic surfaces, said formulation comprising:

from about 0.02 to about 5% by weight, relative to the total weight of said formulation, of said dicarboxy functionalized polyorganosiloxane of formula (I), from about 1.5 to about 50%, relative to the total weight of said formulation, of at least one nonionic and/or anionic surfactant; and from about 0.1 to about 25% by weight, relative to the total weight of said formulation, of at least one organic and/or inorganic detergent adjuvant.

5. Home care formulation according to claim 1, for cleaning toilet bowls, said formulation comprising:

from about 0.05 to about 5% by weight, relative to the total weight of said formulation, of said dicarboxy functionalized polyorganosiloxane of formula (I);

from about 0.5 to about 10% by weight, relative to the total weight of said formulation, of a surfactant;

optionally from about 0.1 to about 3% by weight, relative to the total weight of said formulation, of a thickener; and from about 0.1 to about 40%, relative to the total weight of said formulation, of an acidic cleaning agent.

6. Home care formulation according to claim 1, for rinsing shower walls, said formulation comprising from about 0.02 to about 5% by weight, relative to the total weight of said formulation, of said dicarboxy functionalized polyorganosiloxane of formula (I);

from about 0.5 to about 5% by weight, relative to the total weight of said formulation, of a surfactant; and from about 0.01 to about 5% by weight, relative to the total weight of said formulation, of a metal-chelating agent.

7. Home care formulation according to claim 1, for cleaning glass-ceramic plates, said formulation comprising from about 0.1% to about 5% by weight, relative to the total weight of said formulation, of said dicarboxy functionalized polyorganosiloxane of formula (I);

from about 0.1% to about 1% by weight, relative to the total weight of said formulation, of a thickener;

from about 10% to about 40% by weight, relative to the total weight of said formulation, of an abrasive agent;

from about 1% to about 10% by weight, relative to the total weight of said formulation, of a nonionic surfactant; and from about 0 to about 7% by weight, relative to the total weight of said formulation, of a glycol.

8. Home care formulation according to claim 1, for cleaning dishes in an automatic dishwasher, said formulation comprising:

from about 0.05% to about 5% by weight, relative to the total weight of said formulation, of said dicarboxy functionalized polyorganosiloxane of formula (I);

from about 0.2% to about 10% by weight, relative to the total weight of said formulation, of a surfactant; and optionally up to about 90% by weight, relative to the total weight of said formulation, of detergent adjuvants;

up to about 30% by weight, relative to the total weight of said formulation, of a bleaching agent optionally with a bleaching activator;

up to about 10% by weight, relative to the total weight of said formulation, of auxiliary cleaning agents;

up to about 50% by weight, relative to the total weight of said formulation, of fillers;

up to about 10% by weight, relative to the total weight of said formulation, of one or a mixture of additives selected from fragrances, dyes, metal-corrosion inhibitors, agents which influence the pH of the formulation, or enzymes.

9. Home care formulation according to claim 1, for rinsing dishes in an automatic dishwasher, said formulation comprising:

from about 0.1% to about 5% by weight, relative to the total weight of said formulation, of said dicarboxy functionalized polyorganosiloxane of formula (I);

from about 0.2% to about 20% by weight, relative to the total weight of said formulation, of a surfactant;

up to about 10% by weight, relative to the total weight of said formulation, of a calcium-sequestering organic acid and;

optionally up to about 15% by weight, relative to the total weight of said formulation, of an auxiliary agent of copolymer of acrylic acid and of maleic anhydride or acrylic acid homopolymers type.

10. Home care formulation according to claim 1, for washing up dishes by hand, said formulation comprising:

from about 0.1% to about 5% by weight, relative to the total weight of said formulation, of said dicarboxy functionalized polyorganosiloxane of formula (I);

from about 3% to about 50% by weight, relative to the total weight of said formulation, of a surfactant;

at least one bactericide or disinfectant and optionally;

at least one synthetic cationic polymer;

a polymer to control the viscosity of the mixture and/or the stability of the foams;

a hydrotropic agent;

a hydrating or wetting agent or an agent for protecting the skin;

a dye, fragrance and preserving agent.

11. Home care formulation according to claim 1, for cleaning window panes, said formulation comprising:

from about 0.001% to about 10% by weight, relative to the total weight of said formulation, of at least one dicarboxy functionalized polyorganosiloxane of formula (I);

from about 0.005% to about 20% by weight, relative to the total weight of said formulation, of at least one nonionic surfactant and/or anionic surfactant;

from about 0.5% to about 15% of solvents; and the remainder being formed of water and one or more of said additives.

12. Home care formulation according to claim 1, for external cleaning of motor vehicles, said formulation comprising:

from about 0.05% to about 5% by weight, relative to the total weight of said formulation, of at least one dicarboxy functionalized polyorganosiloxane of formula (I):

from at least about 1% to about 30%, by weight, relative to the total weight of said formulation, of at least one or a mixture of surfactants selected from nonionic, anionic, amphoteric, zwitterionic or cationic surfactant;

an effective amount up to about 50%, by weight, relative to the total weight of said formulation, of an inorganic and/or organic detergent adjuvant ("builder"); and optionally, a hydrotropic agent, fillers and pH regulators.

13. Home care formulation according to claim 1, for washing laundry, said formulation comprising:

from about 0.01% to about 3% by weight, relative to the total weight of said formulation, of at least one dicarboxy functionalized polyorganosiloxane of formula (I);

from about 5 to about 70%, by weight, relative to the total weight of said formulation, of at least one surfactant;

from about 5 to about 50% by weight, relative to the total weight of said formulation, of an inorganic and/or organic detergent adjuvent ("builder"); and optionally from about 0.01 to about 10% by weight, relative to the total weight of said formulation, of a soil release polymer;

from about 0.01 to about 10% by weight, relative to the total weight of said formulation, of an anti-redeposition agent; and from about 0.05 to about 5% by weight, relative to the total weight of said formulation, of an anti-color agent.

14. Home care formulation according to claim 1, which is an aqueous biocidal formulation comprising:

from about 0.01 to about 20%, of at least one biocidal agent from about 0.1 to about 50%, of at least one surfactant, and from about 0.005 to about 10% by weight of at least one dicarboxy functionalized polyorganosiloxane of formula (I).

* * * * *

UNITED STATES PATENT AND TRADEMARK OFFICE

CERTIFICATE OF CORRECTION

PATENT NO. : 6,887,836 B2
DATED : May 6, 2003
INVENTOR(S) : Majeti et al.

It is certified that error appears in the above-identified patent and that said Letters Patent is hereby corrected as shown below:

Title page,
Item [73], Assignee, should read -- The Procter & Gamble Company, Cincinnati, Ohio (U.S.) and Rhodia Chimie, 26 quai Alphonse Le Gallo, 92512 Boulogne-Billancourt, Cedex-France --.

Column 5,
Line 1, should read -- 45-7 and Neodol 45-4 sold by Shell Chemical Co., --.

Column 15,
Line 3, should read -- water (75%) and --.
Line 5, should read -- colza oil (10%) --.

Signed and Sealed this

Thirteenth Day of December, 2005

JON W. DUDAS
*Director of the United States Patent and Trademark Office*